United States Patent [19]

Zenoni

[11] Patent Number: 4,926,912

[45] Date of Patent: May 22, 1990

[54] WEFT FEEDING DRUM WITH LAMING ARRAY BRAKE

[75] Inventor: Pietro Zenoni, Leffe, Italy

[73] Assignee: L.G.L. Electronics S.p.A., Bergamo BG, Italy

[21] Appl. No.: 313,412

[22] Filed: Feb. 21, 1989

[30] Foreign Application Priority Data

Mar. 2, 1988 [IT] Italy ..... 67162 A/88
Jun. 14, 1988 [IT] Italy ..... 67559 A/88

[51] Int. Cl.[5] ..... D03D 47/34
[52] U.S. Cl. ..... 139/452; 242/47.01
[58] Field of Search ..... 139/452; 242/47.01, 242/47.12; 66/132 R

[56] References Cited

U.S. PATENT DOCUMENTS 3,995,786 12/1976 Deniega ..... 139/452 X
4,261,526 4/1981 Roj ..... 139/452 X
4,429,723 2/1984 Maroino ..... 139/452
4,434,609 3/1984 Schacht ..... 242/47.01 X

FOREIGN PATENT DOCUMENTS 1900619 9/1970 Fed. Rep. of Germany ... 242/47.01

*Primary Examiner*—Andrew M. Falik
*Attorney, Agent, or Firm*—Guido Modiano; Albert Josif

[57] ABSTRACT

A weft feeding device, for weaving looms, of the type comprising a drum for winding the thread and an array of metallic laminas for braking the thread which unwinds from the drum. The metallic laminas are arranged on the surface of a rotational paraboloid. The paraboloid is fitted on the drum and is tangent thereto, to elastically engage a thread, at its own minimum-radius circumference. The paraboloid has one end rigidly coupled to a fixed supporting ring which encircles the drum, the other free of the paraboloid end being subject to the action of a movable ring which, when moved axially with respect to the paraboloid, varies the paraboloid's curvature in order to correspondingly vary the contact pressure of the laminas on the thread.

12 Claims, 4 Drawing Sheets

WEFT FEEDING DRUM WITH LAMING ARRAY BRAKE

BACKGROUND OF THE INVENTION

The present invention relates to a weft feeding device, particularly for shuttle-less looms, of the type comprising a fixed cylindrical drum on which a plurality of turns of thread is wound to constitute a feed reserve, means for advancing said reserve turns from the base towards the end of the drum and means for braking the outgoing thread which unwinds from the drum to be fed to the loom or to another textile machine with which the feeder is associable.

In this type of feeder it is very important that the braking means ensure a regular and constant tension of the outgoing thread, in order to avoid its breakage due to sudden variations in tension and to avoid the forming of socalled "baloons" or at least control their extent and keep it within acceptable limits.

Various types of braking means have been produced for this purpose, but all of them substantially belong to two categories: brush means and means with sheet metal or lamina arrays.

The first type comprises means which employ the braking action exerted by brushes which are supported by a ring and are pushed to contact the drum to a greater or smaller extent by adjusting the position of the ring with respect to the drum. This system is very effective for controlling "baloons", but scarcely effective for braking and therefore for controlling the thread's tension, due to the rapid wear of the bristles and to the discontinuity of the action exerted thereby. The second type of means, with arrays of metallic laminas, obviates this disadvantage but entail greater mechanical complexity due to the need to uniformly distribute among all the laminas of the array the pressure which pushes them into contact with the drum, in order that the elastic action exerted on the thread is equal for all the laminas.

For this purpose, it is known to arrange the array of laminas along a truncated-cone surface and to arrange said laminas in a cup-shaped support which is frontally arranged on the dome of the drum. The support can be elastic or rigid, and is adjustably pushed against the drum according to the braking pressure to be exerted. In the first case the elasticity of the support is relied upon to correctly and uniformly distribute the tension among the laminas, while in the second case the uniform distribution is achieved by suspending the support with a universal-type joint which gives said support the ability to self-center with respect to the drum.

The solution employing the elastic support is evidently scarcely reliable for the specified purpose, as it entails a rigorous structural uniformity of the elastic elements which constitute it.

The solution employing the self-centering support, on the other hand, entails a significant increase in the structural complexity of the feeder. Both solutions furthermore have the disadvantage that the points of tangency between the laminas and the drum are arranged on a circumference which is not the maximum circumference of the drum and that the radius of said circumference decreases significantly as the contact pressure rises; both circumstances considerably limit the locking action on the "baloon" of the thread and the range of adjustment of the braking action.

SUMMARY OF THE INVENTION

The aim of the present invention is to eliminate these disadvantages, and within this general aim it provides an important improvement to metal-lamina braking means to achieve the following particular objects: to radically simplify the structure of said means and significantly improve their functionality in terms of the regular and constant distribution of the braking action and in terms of the elimination of "baloons" of thread; to significantly increase the adjustment range of the braking action and therefore of the output tension of the thread, consequently making the feeder adaptable to threads even with very different counts; to allow the adjustment of the tension in an extremely gradual manner.

The above aim, as well as others which become apparent hereinafter, are achieved by a weft feeding device for weaving looms of the type comprising a drum for winding the thread on an array of metallic laminas.

BRIEF DESCRIPTION OF THE DRAWINGS

The characteristics, purposes and advantages of the present invention will become apparent from the following detailed description and with reference to the accompanying drawings, given only by way of non-limitative example, wherein.

DESCRIPTION OF THE PREFERRED EMBODIMENTS

Figure 1:
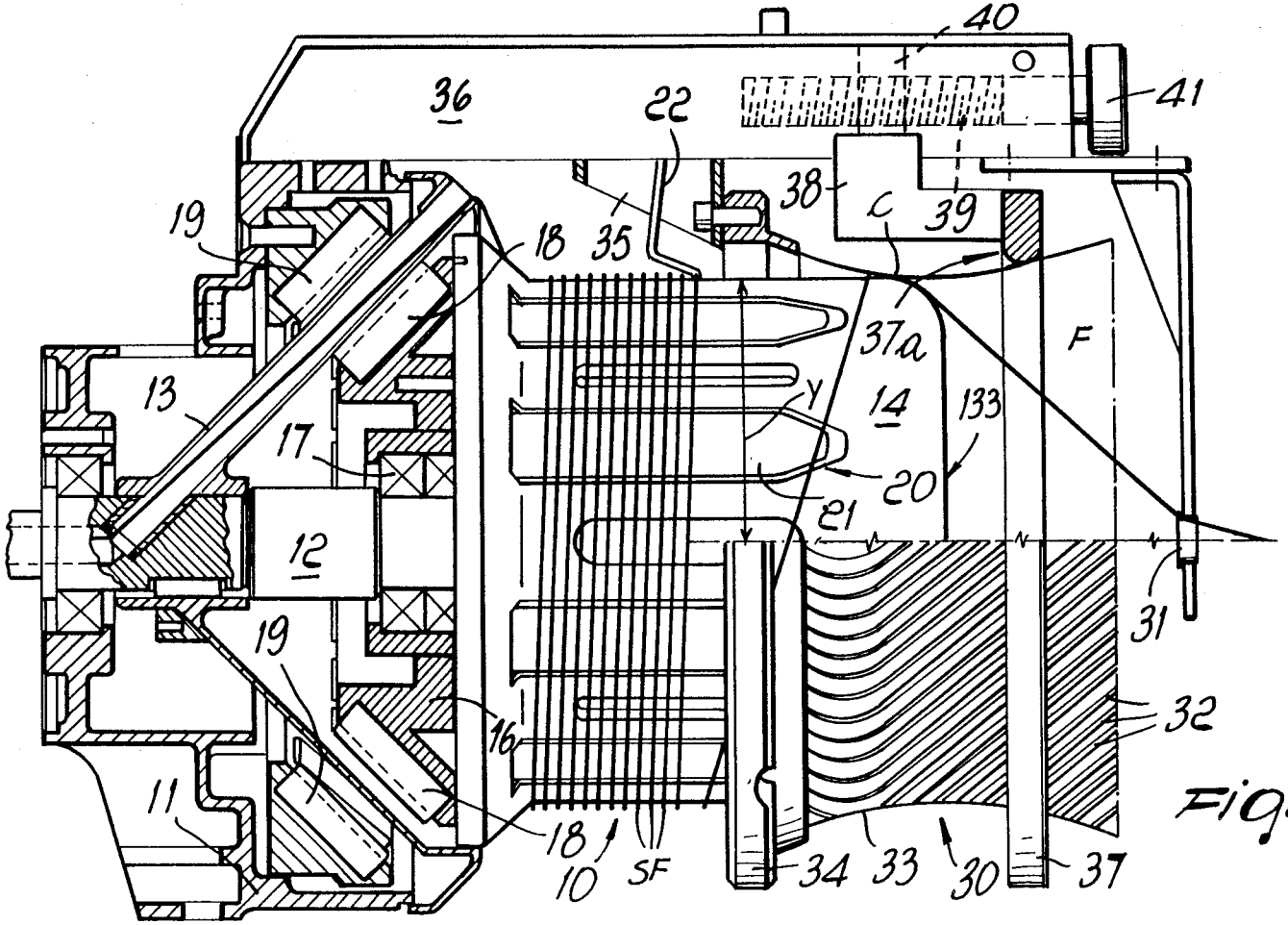
FIG. 1 is a partially sectional view of the weft feeder with the improved thread braking means according to the present invention.
Figure 2:
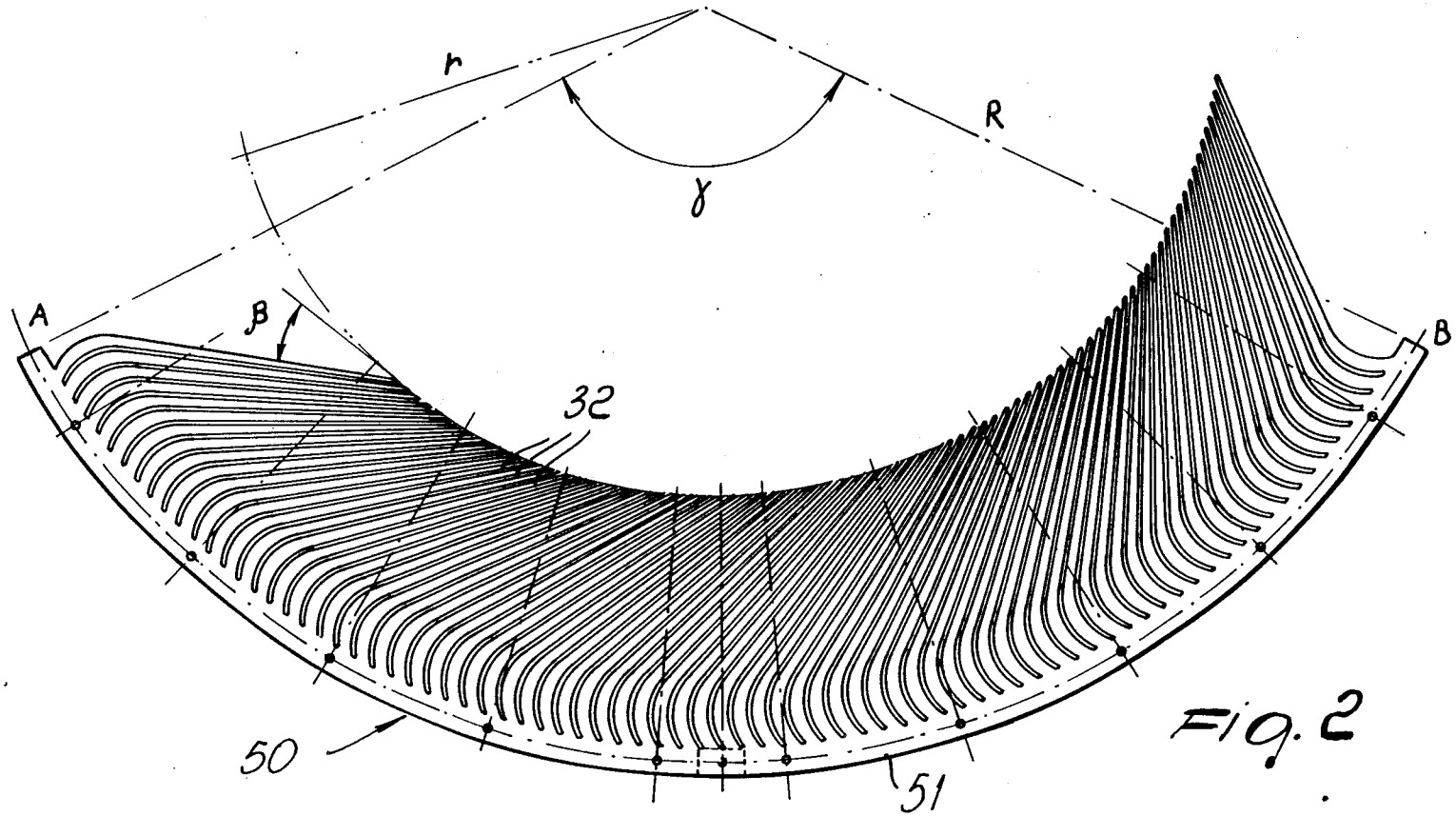
FIG. 2 is a planar development of the paraboloid of braking laminas.

With reference to FIGS. 1 and 2, the reference numeral 10 generally indicates the feeder device, known as weft feeder or supply, which comprises, according to a per se known structure, a fixed support 11 accommodating a hollow motor shaft 12 bearing an also hollow inclined arm 13 which, as an effect of the rotation of the shaft 12, winds a plurality of turns of thread SF on a fixed drum 14: the thread unwinds from a spool (not illustrated) and passes in the cavity of the shaft and of the arm. The drum 14 is mounted on, and rigidly coupled to, a support 16 mounted on the shaft 12 through bearings 17 and is held by the action of magnets 18 which co-operate with magnets 19 of complementary polarity supported by the fixed support 11. The drum 14 has axial slots 20 allowing rods 21 to cyclically and partially protrude therefrom by virtue of a compound motion imparted to said rods in a known manner by the shaft 12, in order to provide the spaced advancement, controlled by a feeler 22, of the turns of thread SF.

The means for braking the thread F are generally indicated by the reference numeral 30 and are arranged at a dome-shaped end 133 of the drum; said means are adapted to control the tension of said thread which unwinds from the drum and passes through a thread guide 31 to be sent to the loom or to another textile machine.

According to the present invention, said means are constituted by an array of metallic laminas or sheet metals 32 arranged according to the surface of a rotational paraboloid 33. The paraboloid 33 is fitted on the drum 14 and is tangent thereto, to elasticallY engage the thread F, at its own minimum-radius circumference.

As clearly illustrated in the figure, the points of tangency are arranged on the outer circumference of the drum in a position which is adjacent but precedes the dome-shaped end of said drum. An end of the paraboloid 33 is rigidly connected, for example by riveting, to a fixed supporting ring 34 rigidly associated, by means of a bracket 35, to a fixed structure 36 which is rigidly associated with the support 11 and extends to the side of the drum 14 and parallel thereto. The other free end of the paraboloid 33 extends axially beyond the drum and is subject, at the outer portion of the drum, to the action of a movable ring 37 which, when it is moved axially with respect to the paraboloid, varies the paraboloid's curvature and consequently varies the contact pressure of the laminas 32 on the thread F along the above mentioned tangency circumference.

For this purpose, the ring 37 is connected to a slider 38 supported by the fixed structure 36, for example by means of guiding and retention columns, so that it can move axially with respect to the drum. The slider 38 is moved by a threaded shaft 39 which engages the threaded hole of a female thread 40 rigidly associated with said slider, and the shaft 39 has a terminal actuation knob 41 which protrudes frontally from the feeder.

The active surface 37*a* of the movable ring which engages the paraboloid 33 preferably has a substantially toroidal profile.

The paraboloid of laminas is obtained starting from a steel sheet 50 having a thickness comprised between 0.1 and 0.2 millimeters, the planar development whereof is illustrated in FIG. 2; the array of laminas 32 is preferably obtained by photoengraving.

Said array originates from a base crown 51, the ends A and B whereof are stably and mutually coupled, for example by welding, after said steel-sheet has been engraved and then curved around an axis which is perpendicular to the plane of the drawing to form the paraboloid 33 having said axis. In order to form the paraboloid by curving the sheetsteel as specified, the factors $\beta$, R and $\gamma$ shown in FIG. 2 must satisfy the following equivalences:

$\beta=30°.30'$; $R=K/\sin(\alpha/2)=C/\gamma$; $K=1.14y$; $r/R=0.63$; $K/H=0.36$ where y is the radius of the drum 14, K is the base radius of a virtual cone having an apex angle $\alpha$, H is the height of said cone, C is the circumference of the fixed ends of the paraboloid, and $\gamma$ is the angle which subtends an arc which is equal in extension to the circumference C.

The base crown 51 of the paraboloid thus obtained is used to stably couple said paraboloid to the fixed ring 34 as described above.

Figure 3:
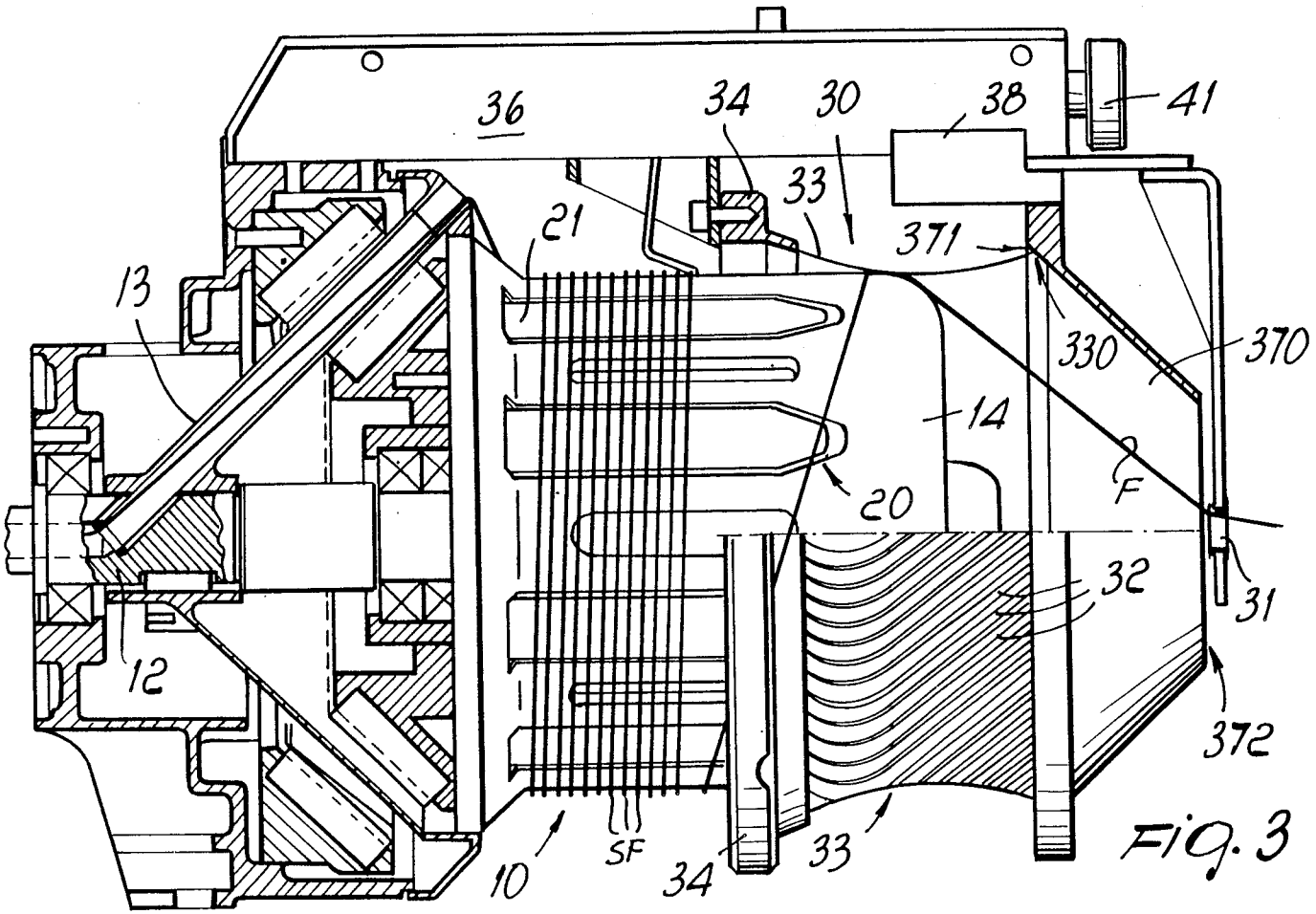
FIG. 3 is a partially sectional view, similar to FIG. 1, of a variated embodiment of the braking means, illustrated in the position corresponding to the minimum value of the elastic braking tension.
Figure 4:
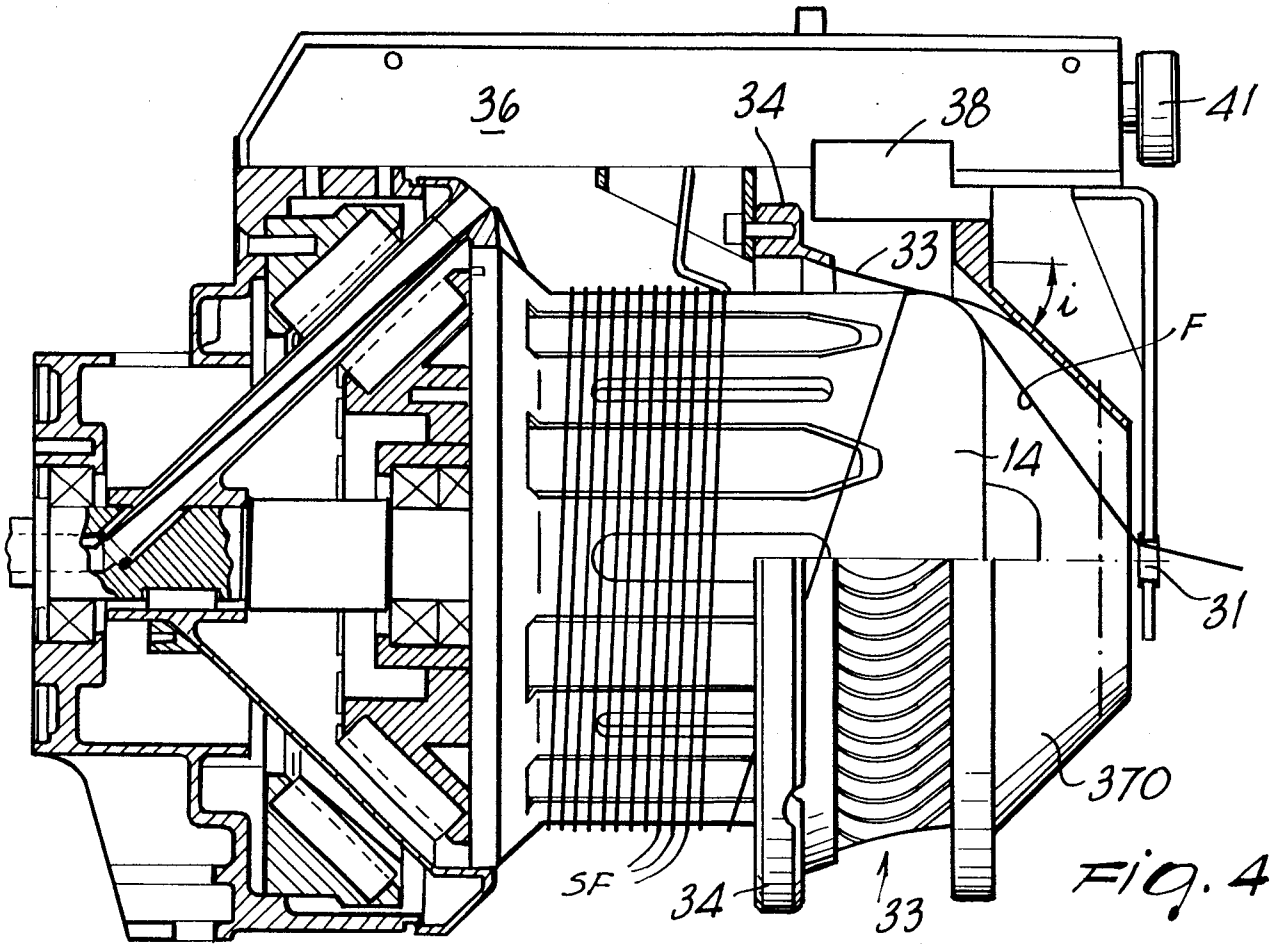
FIG. 4 is a view, similar to FIG. 3, of said braking means in the position corresponding to the maximum value of the elastic braking tension.

According to the variated embodiment illustrated in FIGS. 3 and 4, in which the parts which are similar or corresponding to those of FIGS. 1 and 2 are indicated by the same reference numerals, the movable ring 370, or at least its active surface, has the shape of a truncated cone and its greater section 371 is directed towards the drum 14 to contain the free end of the paraboloid 33 which, as clearly illustrated in the figure, has a slightly rounded connecting lip 330.

The truncated-cone ring 370 is advantageously made of polymeric material and the ratio between the diameters of its two greater and smaller sections 371 and 372 is comprised between 1.8 and 2.2; the diameter of the section 371 is 1.15 to 1.25 times greater than the diameter of the drum 14.

On the other hand, the axial extension of the ring 370 is smaller than that of the drum 14, for example 0.35 to 0.45 times smaller, so that the taper ratio i is comprised between 43° and 49°.

The ring 370 is connected to the slider 38, which is actuated by the movement mechanism 39-40-41 which has already been described in detail. The tension of the laminas 32, however, is adjusted in the opposite manner with respect to what has been described above, as the increase in the elastic contact pressure between the laminas 32 and the drum 14 is produced, according to said variated embodiment, by moving the ring 370 towards the base of the drum 14 instead of towards its outer region.

In fact, by virtue of this movement of the ring 370, the inner truncated-cone surface of said ring produces a deformation of the paraboloid 33 as illustrated in FIG. 2, and the arrangement is such that small axial movements of said ring correspond, by virtue of the taper of said ring, to marked deformations of the paraboloid and even to the reversal of the curvature thereof.

Without varying the dimensions and the stroke of the ring 370, the adjustment range of the pressure exerted by the laminas 32 on the thread is consequently increased significantly, and an effective braking action can be exerted even on very small count threads while containing the original curvature of the paraboloid 33 within modest limits.

What is claimed:

1. A weft feeding device, for looms, of the type comprising a drum for winding the thread and means for braking the thread which unwinds from the drum including an array of metallic laminas fitted on and tangent to the drum, wherein said array of laminas is arranged according to the surface of a rotational paraboloid, said paraboloid having a minimum-circumference radius, said paraboloid elastically engaging the thread at said own minimum-circumference radius; said paraboloid having one end rigidly coupled to a fixed supporting ring which encircles the drum and its other free end subject to the action of a movable ring which, when moved axially with respect to the paraboloid, varies curvature of said paraboloid to correspondingly vary the contact pressure of the laminas on the thread.

2. A weft feeding device according to claim 1, wherein points of tangency between the paraboloid of laminas and the thread winding drum are arranged on the outer circumference of the drum in a position which is adjacent but precedes a dome shaped end of said drum.

3. A weft feeding device according to claim 1, wherein said movable ring is supported by a slider which is in turn supported by a fixed structure of the device so as to be axially movable, said fixed structure extending parallel to the thread winding drum.

4. A weft feeding device according to claim 3, wherein said slider has a female thread engaged by a threaded portion of an actuation shaft having a control knob.

5. A weft feeding device according to claim 1, wherein said paraboloid of laminas is obtained by curving around the axis of said paraboloid a steel-sheet on which the array of laminas has been previously separated, said laminas extending from a base crown having stably and mutually coupled ends.

6. A weft feeding device according to claim 5, wherein said steel-sheet has a thickness comprised between 0.1 and 0.2 millimeters.

7. A weft feeding device according to claim 5, wherein said steel-sheet, when flattened, has substantially the shape of a circular sector having geometrical parameters which satisfy the following equivalences:

$\beta=30°30'$; $R=K/\sin(\alpha/2) = C/\gamma$; $r/R=0.63$; $K=1.14y$; $K/H=0.36$ where:

$\beta$ is the angle of inclination of the laminas,

R is a maximum radius of the development sector of said paraboloid, r is the minimum radius of the development sector, $\gamma$ is the center angle of the development sector, y is the radius of the thread winding drum, C is the circumference of the fixed end of the paraboloid, K is the base radius of a virtual cone having an apex angle $\alpha$, and H is the height of the virtual cone.

8. A weft feeding device according to claim 5, wherein the base crown from which the laminas extend is stably connected to said fixed ring.

9. A weft feeding device according to claim 1, wherein the active surface of the movable ring which engages the paraboloid of laminas has a substantially toroidal profile.

10. A weft feeding device according to claim 1, wherein the active surface of the movable ring which engages the paraboloid has the shape of a truncated cone with a greater and a smaller section, and wherein the greater section of the ring is directed towards the drum of the device.

11. A device according to claim 10, wherein the truncated-cone active surface of the ring has a ratio between the diameters of its two greater and smaller sections which is comprised between 1.8 and 2.2 and in that the diameter of the greater section is 1.15 to 1.25 times greater than the diameter of said drum.

12. A device according to claim 10, wherein the taper ratio of said active surface of the ring is comprised between 43° and 49°.

* * * * *